US006357450B1

(12) United States Patent
Paice

(10) Patent No.: US 6,357,450 B1
(45) Date of Patent: Mar. 19, 2002

(54) HAIR DYE APPLICATOR

(76) Inventor: Andrew Paice, 48 Furze Lane, Purley, Surrey, England CR8 3EG (GB)

( * ) Notice: Subject to any disclaimer, the term of this patent is extended or adjusted under 35 U.S.C. 154(b) by 0 days.

(21) Appl. No.: 09/751,732

(22) Filed: Dec. 29, 2000

(51) Int. Cl.[7] ..... A45D 24/22

(52) U.S. Cl. ..... 132/114; 222/137; 222/192

(58) Field of Search ..... 132/112, 113, 132/114, 148, 221; 433/89, 90; 222/137, 145.5, 145.6, 192

(56) References Cited

U.S. PATENT DOCUMENTS

| | | | | | |
|---|---|---|---|---|---|
| 678,004 | A | * | 7/1901 | Myers | 132/114 |
| 1,172,889 | A | | 2/1916 | Holden | |
| 3,477,447 | A | | 11/1969 | Eldredge | |
| 3,861,407 | A | | 1/1975 | Gabriele | |
| D314,840 | S | | 2/1991 | Graley | |
| 5,076,298 | A | | 12/1991 | Busch et al. | |
| 5,104,005 | A | * | 4/1992 | Schneider, Jr. et al. | 222/137 |
| 5,339,839 | A | | 8/1994 | Forcelledo et al. | |
| 5,875,928 | A | * | 3/1999 | Muller et al. | 222/137 |
| 6,234,795 | B1 | * | 5/2001 | Fischer | 433/90 |

* cited by examiner

*Primary Examiner*—Gene Mancene
*Assistant Examiner*—Eduardo C. Robert

(57) ABSTRACT

A hair dye applicator for mixing dye gel and peroxide as needed. The hair dye applicator includes a housing having a top wall, a bottom wall, a front wall, a back wall and a pair of lateral side walls. A cartridge comprises a first tubular member and a second tubular member coupled together. Each of the tubular members has an open first end and a closed second end. Each of the second ends of the tubular member has a hole extending therein. An annular lip is integrally coupled to the second end and encompasses the holes in the second end. Dye gel is positioned in one of the tubular members and peroxide activator is positioned in the other of the tubular members. A coupling member removably couples the first end of the cartridge to the front wall of the housing. A generally hollow rod and has open first and second ends. A bracket member releasably secures the first end of the rod to the second end of the cartridge. The second end of the rod extends into and is fluidly coupled to a manifold. A plurality of conduits is fluidly coupled to and extends away from the front side of the manifold. An actuator assembly forces the gel dye and peroxide activator out of the cartridge and into the manifold.

12 Claims, 3 Drawing Sheets

HAIR DYE APPLICATOR

BACKGROUND OF THE INVENTION

1. Field of the Invention

The present invention relates to hair dye application devices and more particularly pertains to a new hair dye applicator for mixing dye gel and peroxide as needed and applying the mixture on the hair.

2. Description of the Prior Art

The use of hair dye application devices is known in the prior art. More specifically, hair dye application devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,172,889; U.S. Pat. No. 5,076,298; U.S. Pat. No. 3,861,407; U.S. Pat. No. 5,339,839; U.S. Pat. No. 3,477,447; and U.S. Des. Pat. No. 314,840.

While these devices fulfill their respective, particular objectives and requirements, the aforementioned patents do not disclose a new hair dye applicator. The inventive device includes a housing having a top wall, a bottom wall, a front wall, a back wall and a pair of lateral side walls. A cartridge comprises a first tubular member and a second tubular member coupled together. Each of the tubular members has an open first end and a closed second end. Each of the second ends of the tubular member has a hole extending therein. An annular lip is integrally coupled to the second end and encompasses the holes in the second end. Dye gel is positioned in one of the tubular members and peroxide activator is positioned in the other of the tubular members. A coupling member removably couples the first end of the cartridge to the front wall of the housing. A generally hollow rod and has open first and second ends. A bracket member releasably secures the first end of the rod to the second end of the cartridge. The second end of the rod extends into and is fluidly coupled to a manifold. A plurality of conduits is fluidly coupled to and extends away from the front side of the manifold. An actuator assembly forces the gel dye and peroxide activator out of the cartridge and into the manifold.

In these respects, the hair dye applicator according to the present invention substantially departs from the conventional concepts and designs of the prior art, and in so doing provides an apparatus primarily developed for the purpose of mixing dye gel and peroxide as needed.

SUMMARY OF THE INVENTION

In view of the foregoing disadvantages inherent in the known types of hair dye application devices now present in the prior art, the present invention provides a new hair dye applicator construction wherein the same can be utilized for mixing dye gel and peroxide as needed.

The general purpose of the present invention, which will be described subsequently in greater detail, is to provide a new hair dye applicator apparatus and method which has many of the advantages of the hair dye application devices mentioned heretofore and many novel features that result in a new hair dye applicator which is not anticipated, rendered obvious, suggested, or even implied by any of the prior art hair dye application devices, either alone or in any combination thereof.

To attain this, the present invention generally comprises a housing having a top wall, a bottom wall, a front wall, a back wall and a pair of lateral side walls. A cartridge comprises a first tubular member and a second tubular member coupled together. Each of the tubular members has an open first end and a closed second end. Each of the second ends of the tubular member has a hole extending therein. An annular lip is integrally coupled to the second end and encompasses the holes in the second end. Dye gel is positioned in one of the tubular members and peroxide activator is positioned in the other of the tubular members. A coupling member removably couples the first end of the cartridge to the front wall of the housing. A generally hollow rod and has open first and second ends. A bracket member releasably secures the first end of the rod to the second end of the cartridge. The second end of the rod extends into and is fluidly coupled to a manifold. A plurality of conduits is fluidly coupled to and extends away from the front side of the manifold. An actuator assembly forces the gel dye and peroxide activator out of the cartridge and into the manifold.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair dye applicator apparatus and method which has many of the advantages of the hair dye application devices mentioned heretofore and many novel features that result in a new hair dye applicator which is not anticipated, rendered obvious, suggested, or even implied by any of the prior art hair dye application devices, either alone or in any combination thereof.

It is another object of the present invention to provide a new hair dye applicator which may be easily and efficiently manufactured and marketed.

It is a further object of the present invention to provide a new hair dye applicator which is of a durable and reliable construction.

An even further object of the present invention is to provide a new hair dye applicator which is susceptible of a low cost of manufacture with regard to both materials and labor, and which accordingly is then susceptible of low prices of sale to the consuming public, thereby making such hair dye applicator economically available to the buying public.

Still yet another object of the present invention is to provide a new hair dye applicator which provides in the apparatuses and methods of the prior art some of the advantages thereof, while simultaneously overcoming some of the disadvantages normally associated therewith.

Still another object of the present invention is to provide a new hair dye applicator for mixing dye gel and peroxide as needed.

Yet another object of the present invention is to provide a new hair dye applicator which includes a housing having a top wall, a bottom wall, a front wall, a back wall and a pair of lateral side walls. A cartridge comprises a first tubular member and a second tubular member coupled together. Each of the tubular members has an open first end and a closed second end. Each of the second ends of the tubular member has a hole extending therein. An annular lip is integrally coupled to the second end and encompasses the holes in the second end. Dye gel is positioned in one of the tubular members and peroxide activator is positioned in the other of the tubular members. A coupling member removably couples the first end of the cartridge to the front wall of the housing. A generally hollow rod and has open first and second ends. A bracket member releasably secures the first end of the rod to the second end of the cartridge. The second end of the rod extends into and is fluidly coupled to a manifold. A plurality of conduits is fluidly coupled to and extends away from the front side of the manifold. An actuator assembly forces the gel dye and peroxide activator out of the cartridge and into the manifold.

Still yet another object of the present invention is to provide a new hair dye applicator that keeps the gel dye and peroxide separate until needed.

Even still another object of the present invention is to provide a new hair dye applicator that has fins within the rod for thoroughly mixing the gel day and the peroxide.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
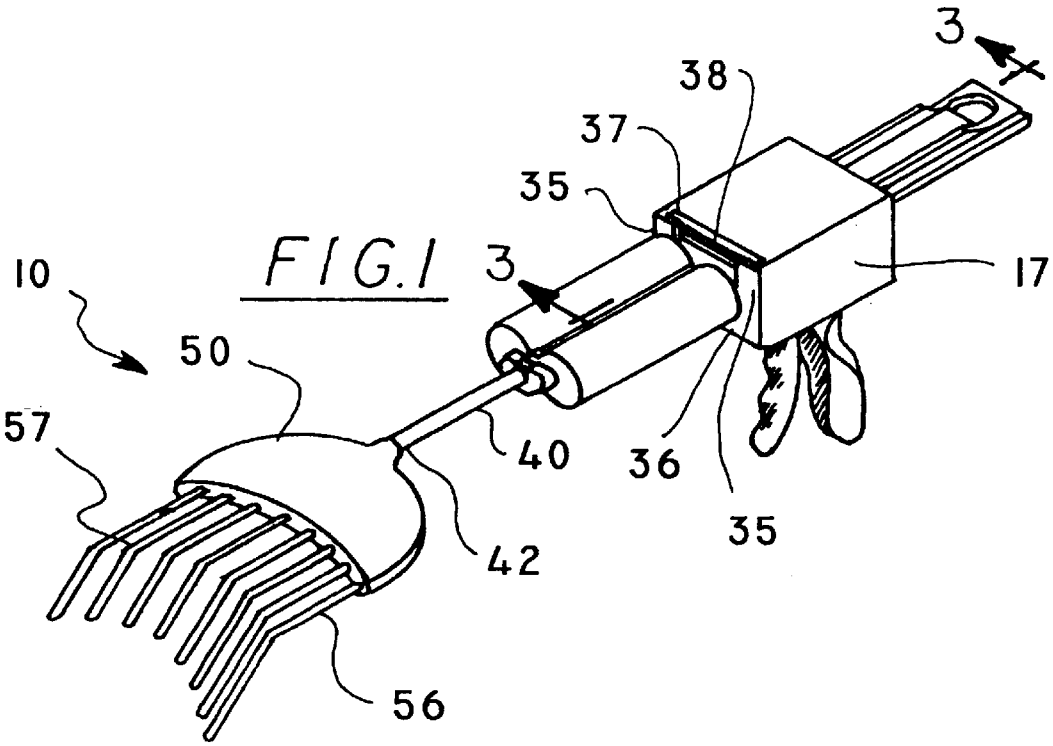
FIG. 1 is a schematic perspective view of a new hair dye applicator according to the present invention.
Figure 3:
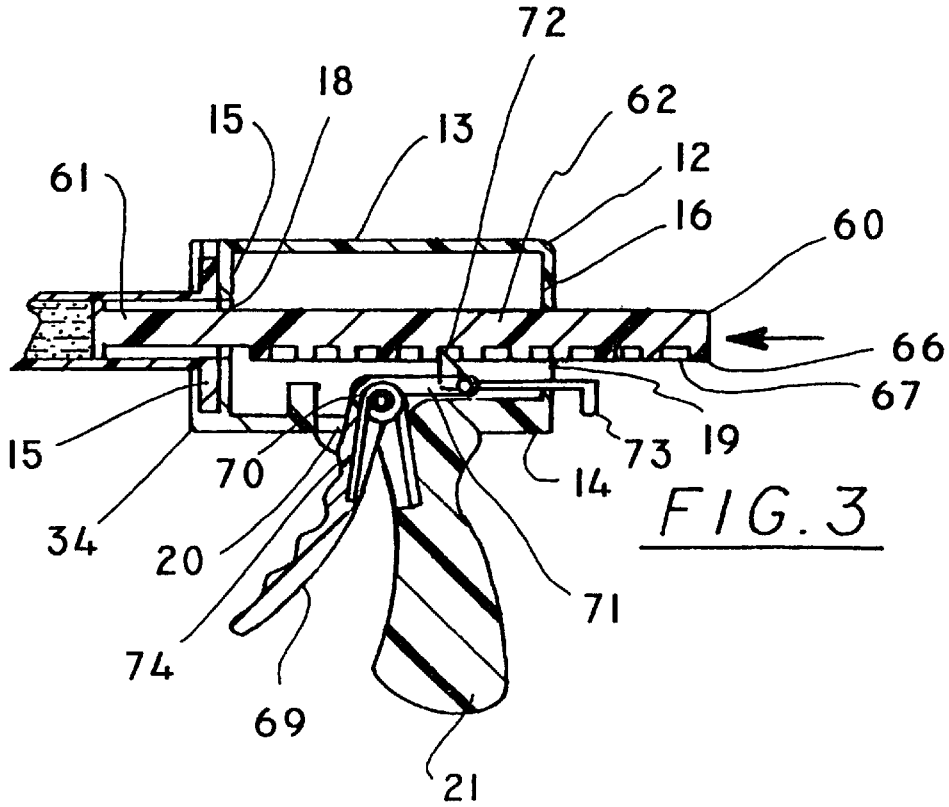
FIG. 3 is a schematic cross-sectional view taken along line 3—3 of the present invention.
Figure 2:
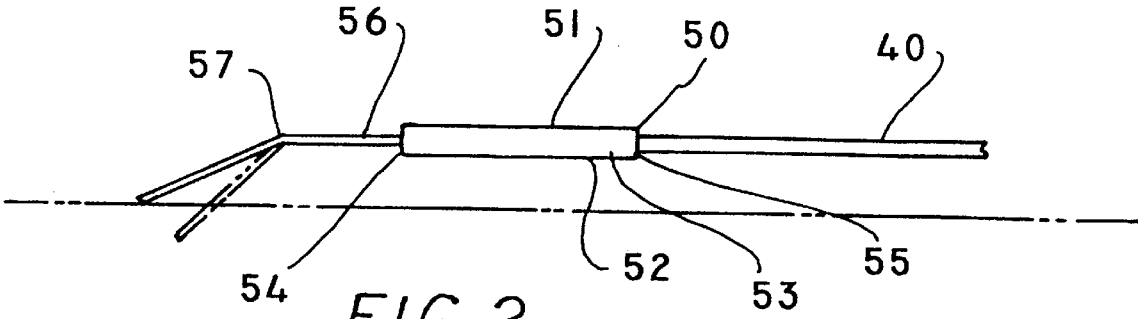
FIG. 2 is a schematic side view of the rod, conduit and manifold of the present invention.
Figure 8:
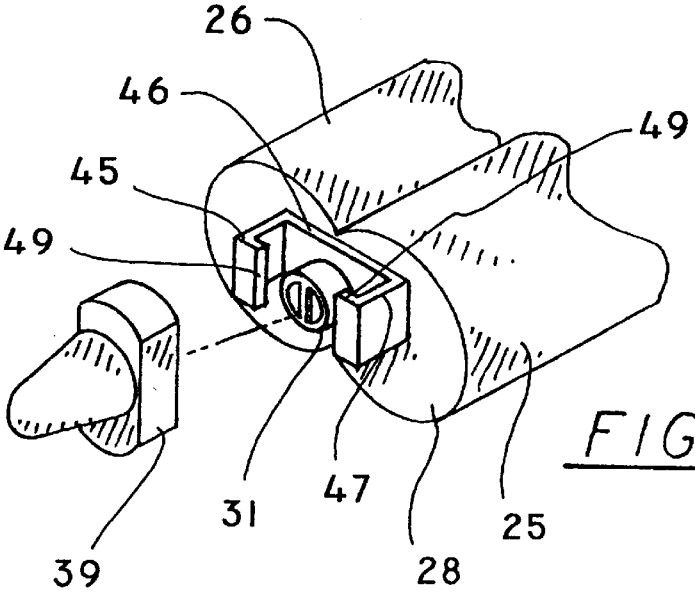
FIG. 8 is a schematic perspective view of the covering of the present invention.
Figure 4:
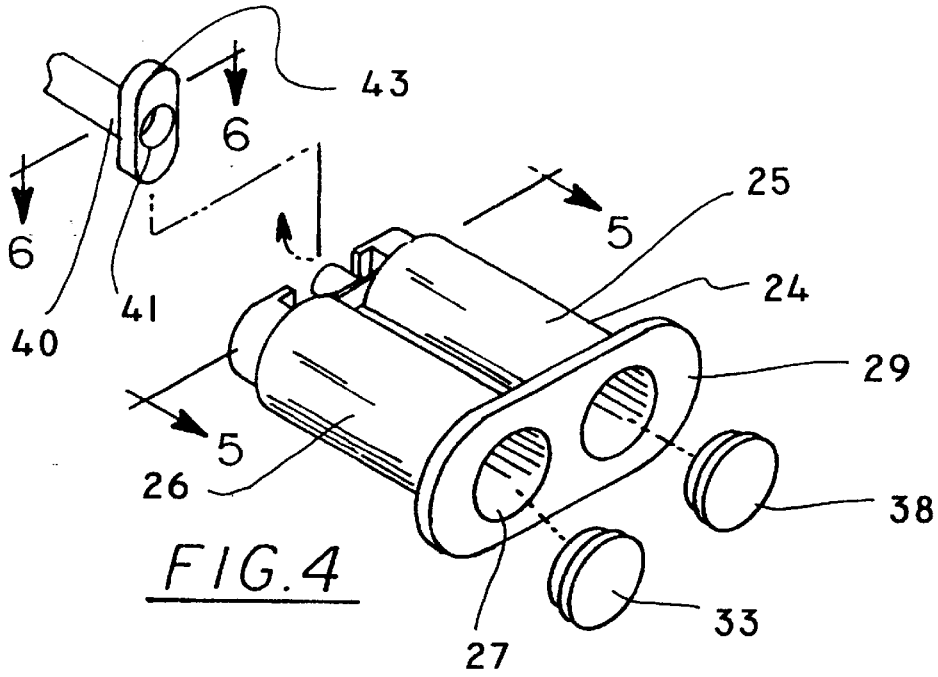
FIG. 4 is a schematic perspective view of the cartridge of the present invention.
Figure 5:
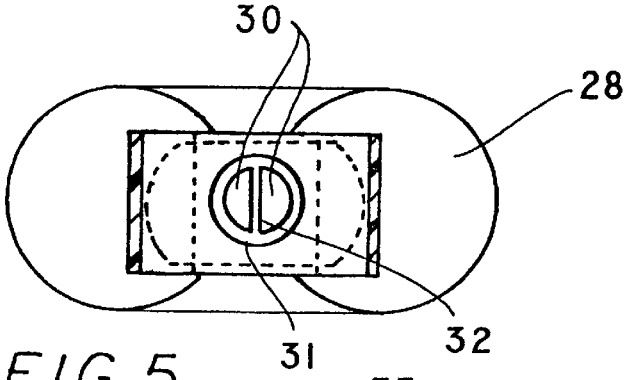
FIG. 5 is a schematic cross-sectional view taken along line 5—5 of the present invention.
Figure 6:
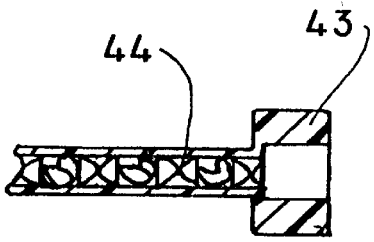
FIG. 6 is a schematic cross-sectional view taken along line 6—6 of the present invention.
Figure 7:
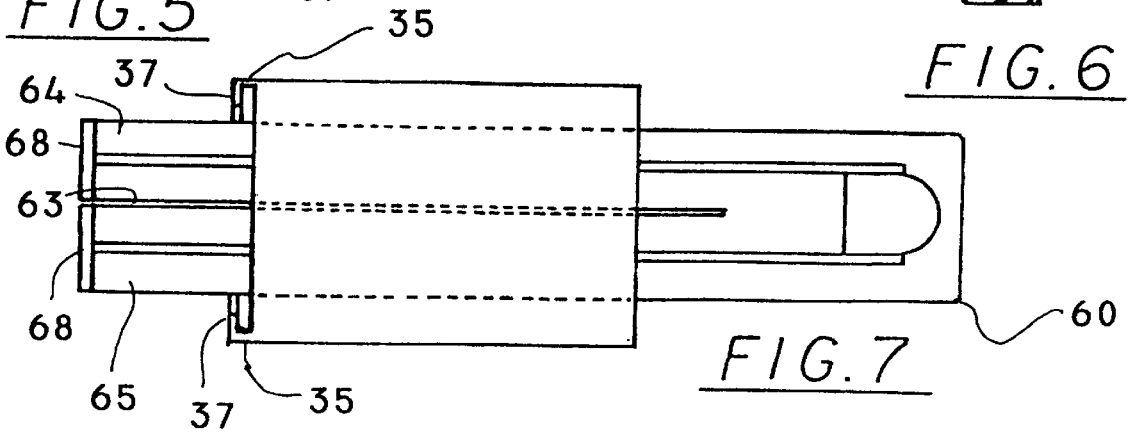
FIG. 7 is a schematic top view of the housing and ram of the present invention.

With reference now to the drawings, and in particular to FIGS. 1 through 8 thereof, a new hair dye applicator embodying the principles and concepts of the present invention and generally designated by the reference numeral 10 will be described.

As best illustrated in FIGS. 1 through 8. The hair dye applicator 10 generally comprises a housing 12 having a top wall 13, a bottom wall 14, a front wall 15, a back wall 16 and a pair of lateral side walls 17. The front wall 15 has a pair of holes 18 extending therethrough. The back wall 16 has an opening 19 extending therethrough. The bottom wall 14 has an aperture 20 extending therethrough and positioned generally between the front 15 and back 16 walls.

A handle 21 is integrally coupled to and extends downwardly from the bottom wall 14. The handle 21 is positioned between the aperture 20 in the bottom wall 14 and the back wall 16.

A cartridge 24 comprises a first tubular member 25 and a second tubular member 26. Each of the tubular members has a peripheral wall. The peripheral wall of the first tubular member 25 is integrally coupled to the peripheral wall of the second tubular member 26 such that each has a longitudinal axis orientated generally parallel to each other. Each of the tubular members 25, 26 has an open first end 27 and a closed second end 28. The first end 27 of the cartridge has a peripheral flange 29 integrally coupled thereto. Each of the second ends 28 of the tubular members has a hole 30 extending therethrough. Each of the holes 30 in the tubular members is positioned generally adjacent to each other. An annular lip 31 is integrally coupled to and extends away from the second end 28 of the tubular members and generally extends around the holes 30 in the tubular members. A dividing wall 32 for dividing the annular lip 31 into two portions is integrally coupled to an inner wall of the annular lip 31 such that each of the portions are in fluid communication with one of the holes 30 in the tubular members.

A coupling member 34 removably couples the first end of the cartridge 25 to the front wall 15 of the housing. The coupling member 34 is adapted for engaging the flange 29 on the cartridge 24. The coupling member 34 has two leg portions 35 and a bottom portion 36 such that the coupling member 34 is generally U-shaped. Each of the leg portions 35 is integrally coupled to the front wall 15 and extends away from one of the side walls 17. The bottom portion 36 is integrally coupled to the front wall 15 and extends away from the bottom wall 14. Each of the leg portions 35 and the bottom portion 36 has a shoulder 37 integrally coupled thereto and extending towards each other such that a slot 38 is defined between the shoulder 37 and the front wall 15 for removably receiving the flange 29. Each of the open ends 27 of the tubular members is generally aligned with one of the holes 18 in the front wall 15. The first tubular member 25 may be filled with a dye gel and the second tubular member 26 may be filled with a peroxide activator.

A pair of cap members 33 removably closes the first ends 27 of the tubular members 25, 26. Each of the cap members 33 is positionable in the first ends 27 of the tubular members 25, 26 and each is frictionally held therein. A covering 39 may be positioned over the annular lip 31. The cap members 33 and the covering 39 allow a user to close the cartridge 24 and keep the dye gel and peroxide separate from each other.

A rod 40 is elongate and has a first end 41 and a second end 42. The rod 40 is generally hollow and has open first 41 and second 42 ends. A first end 41 of the rod 40 has an oblong lip 43 integrally coupled thereto. The rod 40 has an inner wall having a plurality of fins 44 integrally coupled thereto.

A bracket member 45 releasably secures the first end 41 of the rod 40 to the second end 28 of the cartridge 24. The bracket member 45 comprises a base member 46 and a pair of legs 47 integrally coupled to opposite ends of the base member 46. The base member 46 is securely attached to the second end 28 of the cartridge 24 such that the annular lip 31 extends through the base member 46. Each of the legs 47 has a free end having a lip 49 thereon. The lips 49 on the legs extend toward each other. The annular lip 31 may be inserted into the first end 41 of the rod 40, and the oblong lip 43 may be positioned between the cartridge 24 and the lips 49 on the bracket member 45.

A manifold 50 has a top wall 51, a bottom wall 52 and a peripheral wall 53 extending therebetween. The manifold 50 has a front side 54 and a back side 55. The second end 42 of the rod 40 extends into the back side 55 and is fluidly coupled to the manifold 50.

Each of a plurality of conduits 56 is fluidly coupled to and extends away from the front side 54 of the manifold 50. Each of the conduits 56 has a bend 57 therein such that each of the conduits 56 extends in generally the same direction. Each of the conduits 56 is resiliently flexible. The plurality of conduits may be one conduit and the size of the conduits, their openings and the bends may be altered depending on the desired effect of the dye.

An actuator assembly forces the gel dye and peroxide activator out of the cartridge 24 and into the manifold 50. The actuator assembly includes a ram 60 slidably positioned in the housing 12. The ram 60 has a proximal portion 61 and a distal portion 62. A free end of the proximal portion 61 has a slot 63 extending therein such that a first portion 64 and a second portion 65 of the proximal portion 61 is defined. Each of the first and second portions is extendable through one of the holes 18 in the front wall 15. The ram 60 has a bottom surface 66 having a plurality of notches 67 therein.

Each of a pair of pistons 68 comprises a disc integrally coupled to one of the ends of the first 64 and second 65 portions of the ram. Each of the discs 68 has a diameter generally equal to an inner diameter of each of the tubular members 25, 26 and is extendably positionable therein.

A trigger 69 extends upwardly through the aperture 20 in the bottom wall 14 of the housing 12 and is pivotally coupled to the housing 12. The trigger 69 has a first end 70 positioned in the housing 12. A nub 71 is integrally coupled to the first end 70 of the trigger 69 and extends toward the back wall 16 of the housing 12.

A pawl 72 is hingedly coupled to the nub 71 and is positioned for releasable engaging the notches 67 in the ram 60.

A lever 73 releases the pawl 72 from the notches 67 and is securely attached to the pawl 72. The lever 73 extends outwardly through the opening 19 in the back wall 16.

A biasing means 74 biases a second end 75 of the trigger 69 in a direction toward the front wall 15 of the house 12.

In use, dye gel is placed in one tubular member and peroxide activator in the other. The cap member and covering may close the cartridge so that the dye gel and peroxide do not escape. When needed, the cartridge is attached to the housing. The actuator assembly pushes the dye gel and peroxide through the rod where the fins mix them together. The mixture is then forced into the manifold and out of the conduits for positioning on the hair.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dye application device for applying hair dye to the hair of a person, said device being adapted to mix a gel dye and a peroxide activator, said device comprising:

a housing having a top wall, a bottom wall, a front wall, a back wall and a pair of lateral side walls;

a cartridge, said cartridge comprising a first tubular member and a second tubular member coupled together, each of said tubular members having an open first end and a closed second end, each of said second ends of said tubular member having a hole extending therein, an annular lip being integrally coupled to said second end and encompassing said holes in said second end, wherein said dye gel is positionable in one of said tubular members and said peroxide activator is positionable in the other of said tubular members;

a coupling member for removably coupling said first end of said cartridge to said front wall of said housing, said coupling member being securely coupled to said front wall of said house;

a rod, said rod being elongate and having a first end and a second end, said rod being generally hollow and having open first and second ends;

a bracket member for releasably securing said first end of said rod to said second end of said cartridge such that said annular lip extends into said first end of said rod;

a manifold, said second end of said rod extending into and being fluidly coupled to said manifold;

at least one conduit being fluidly coupled to and extending away from said front side of said manifold; and an actuator assembly for forcing the gel dye and peroxide activator out of said cartridge and into said manifold, said actuator assembly being positioned in said housing and being adapted for extending through said housing and into said cartridge.

2. The dye application device as in claim 1, wherein said housing and said actuator assembly further comprise:

said front wall of said housing having a pair of holes extending therethrough, said back wall having an opening extending therethrough, said bottom wall having an aperture extending therethrough and positioned generally between said front and back walls;

said actuator assembly comprising;

a ram, said ram being slidably positioned in said housing, said ram having a proximal portion and a distal portion, a free end of said proximal portion having a slot extending therein such that a first portion and a second portion of said proximal portion is defined, each of said first and second portions being extendable through one of said holes in said front walls and into one of said tubular members, said ram having a bottom surface having a plurality of notches therein;

a pair of pistons, each of said pistons generally comprising a disc integrally coupled to one of said ends of said first and second portions of said ram, each of said discs having a diameter generally equal to an inner diameter of each of said tubular members and being extendably positionable therein;

a trigger, said trigger extending upwardly through said aperture in said bottom wall of said housing and being pivotally coupled to said housing, said trigger having a first end positioned in said housing, a nub being integrally coupled to said first end of said trigger and extending toward said back wall of said housing; and a pawl being hingedly coupled to said nub and positioned for releasable engaging said notches in said ram.

3. The dye application device as in claim 1, wherein said actuating assembly further includes:

a lever for releasing said pawl being securely attached to said pawl and extending outwardly through said opening in said back wall; and a biasing means for biasing a second end of said trigger in a direction toward said front wall of said house.

4. The dye application device as in claim 1, further including:

a handle, said handle being integrally coupled to and extending downwardly from said bottom wall.

5. The dye application device as in claim 1, wherein said cartridge further comprises:

each of said tubular members having a peripheral wall, said peripheral wall of said first tubular member being integrally coupled to said peripheral wall of said second tubular member such that each has a longitudinal axis orientated generally parallel to each other, said first end of said cartridge having a peripheral flange integrally coupled thereto; and said coupling member being adapted for engaging said flange on said cartridge.

6. The dye application device as in claim 5, wherein said coupling member comprises two leg portions and a bottom portion such that said coupling member is generally U-shaped, each of said leg portions being integrally coupled to said front wall and extending away from one of said side walls, said bottom portion being integrally coupled to said front wall and extending away from said bottom wall, each of said leg portions and said bottom portion having a shoulder integrally coupled thereto and extending towards each other such that a slot is defined between said shoulder and said front wall for removably receiving said flange.

7. The dye application device as in claim 5, further comprising:

a dividing wall for dividing said annular lip into two portions being integrally coupled to an inner wall of said annular lip such that each of said portions are in fluid communication with one of said holes in said tubular members.

8. The dye application device as in claim 1, further comprising:

a pair of cap members for removably closing said first ends of said tubular members, each of said cap members being positionable in said first ends of said tubular members and frictionally held therein.

9. The dye application device as in claim 1, wherein said device comprises:

a first end of said rod having an oblong lip integrally coupled thereto; and said bracket member comprising a base member and a pair of legs integrally coupled to opposite ends of said base member, said base member being securely attached to said second end of said cartridge such that said annular lip extends through said base member, each of said legs having a free end having a lip thereon, said lips on said legs extending toward each other, wherein said annular lip may be inserted into said first end of said rod, wherein said oblong lip may be positioned between said cartridge and said lips on said bracket member.

10. The dye application device as in claim 1, wherein said rod has an inner wall having a plurality of fins integrally coupled thereto.

11. The dye application device as in claim 1, wherein said conduit is a plurality of conduits, each of said conduits having a bend therein such that each of said conduits extend in generally the same direction, each of said conduits being resiliently flexible.

12. A dye application device for applying hair dye to the hair of a person, said device being adapted to mix a gel dye and a peroxide activator, said device comprising:

a housing having a top wall, a bottom wall, a front wall, a back wall and a pair of lateral side walls, said front wall having a pair of holes extending therethrough, said back wall having an opening extending therethrough, said bottom wall having an aperture extending therethrough and positioned generally between said front and back walls;

a handle, said handle being integrally coupled to and extending downwardly from said bottom wall, said handle being positioned between said aperture in said bottom wall and said back wall;

a cartridge, said cartridge comprising a first tubular member and a second tubular member, each of said tubular members having a peripheral wall, said peripheral wall of said first tubular member being integrally coupled to said peripheral wall of said second tubular member such that each has a longitudinal axis orientated generally parallel to each other, each of said tubular members having an open first end and a closed second end, said first end of said cartridge having a peripheral flange integrally coupled thereto, each of said second ends of said tubular member having a hole extending therethrough, each of said holes in said tubular member being positioned generally adjacent to each other, an annular lip being integrally coupled to and extending away from said second end of said tubular members and generally extending around said holes in said tubular members, a dividing wall for dividing said annular lip into two portions being integrally coupled to an inner wall of said annular lip such that each of said portions are in fluid communication with one of said holes in said tubular members;

a coupling member for removably coupling said first end of said cartridge to said front wall of said housing, said coupling member being adapted for engaging said flange on said cartridge, said coupling member having two leg portions and a bottom portion such that said coupling member is generally U-shaped, each of said leg portions being integrally coupled to said front wall and extending away from one of said side walls, said bottom portion being integrally coupled to said front wall and extending away from said bottom wall, each of said leg portions and said bottom portion having a shoulder integrally coupled thereto and extending towards each other such that a slot is defined between said shoulder and said front wall for removably receiving said flange, wherein each of said open ends of said tubular members are generally aligned with one of said holes in said front wall, wherein said first tubular member may be filled with the dye gel and said second tubular member may be filled with the peroxide activator;

a pair of cap members for removably closing said first ends of said tubular members, each of said cap members being positionable in said first ends of said tubular members and frictionally held therein;

a rod, said rod being elongate and having a first end and a second end, said rod being generally hollow and having open first and second ends, a first end of said rod having an oblong lip integrally coupled thereto, said rod having an inner wall having a plurality of fins integrally coupled thereto;

a bracket member for releasably securing said first end of said rod to said second end of said cartridge, said bracket member comprising a base member and a pair of legs integrally coupled to opposite ends of said base member, said base member being securely attached to said second end of said cartridge such that said annular lip extends through said base member, each of said legs having a free end having a lip thereon, said lips on said legs extending toward each other, wherein said annular lip may be inserted into said first end of said rod, wherein said oblong lip may be positioned between said cartridge and said lips on said bracket member;

a manifold, said manifold having a top wall, a bottom wall and a peripheral wall extending therebetween, said manifold having a front side and a back side, said second end of said rod extending into said back side and being fluidly coupled to said manifold;

a plurality of conduits being fluidly coupled to and extending away from said front side of said manifold, each of said conduits having a bend therein such that each of said conduits extend in generally the same direction, each of said conduits being resiliently flexible;

an actuator assembly for forcing the gel dye and peroxide activator out of said cartridge and into said manifold, said actuator assembly comprising;

a ram, said ram being slidably positioned in said housing, said ram having a proximal portion and a distal portion, a free end of said proximal portion having a slot extending therein such that a first portion and a second portion of said proximal portion is defined, each of said first and second portions being extendable through one of said holes in said front walls, said ram having a bottom surface having a plurality of notches therein;

a pair of pistons, each of said pistons generally comprising a disc integrally coupled to one of said ends of said first and second portions of said ram, each of said discs having a diameter generally equal to an inner diameter of each of said tubular members and being extendably positionable therein;

a trigger, said trigger extending upwardly through said aperture in said bottom wall of said housing and being pivotally coupled to said housing, said trigger having a first end positioned in said housing, a nub being integrally coupled to said first end of said trigger and extending toward said back wall of said housing;

a pawl being hingedly coupled to said nub and positioned for releasable engaging said notches in said ram;

a lever for releasing said pawl being securely attached to said pawl and extending outwardly through said opening in said back wall; and a biasing means for biasing a second end of said trigger in a direction toward said front wall of said house.

* * * * *